US009498070B2

(12) United States Patent
Michelson

(10) Patent No.: US 9,498,070 B2
(45) Date of Patent: Nov. 22, 2016

(54) ADJUSTABLE CHILD BOOSTER SEAT

(71) Applicant: Gary K. Michelson, Los Angeles, CA (US)

(72) Inventor: Gary K. Michelson, Los Angeles, CA (US)

( * ) Notice: Subject to any disclaimer, the term of this patent is extended or adjusted under 35 U.S.C. 154(b) by 0 days.

(21) Appl. No.: 13/961,545

(22) Filed: Aug. 7, 2013

(65) Prior Publication Data

US 2014/0265461 A1 Sep. 18, 2014

Related U.S. Application Data

(63) Continuation-in-part of application No. 13/839,158, filed on Mar. 15, 2013.

(51) Int. Cl.

| | |
|---|---|
| ***A47C 1/08*** | (2006.01) |
| ***A47D 1/00*** | (2006.01) |
| ***A47D 1/10*** | (2006.01) |

(52) U.S. Cl.

CPC ..... *A47D 1/004* (2013.01); *A47D 1/008* (2013.01); *A47D 1/103* (2013.01)

(58) Field of Classification Search

CPC ..... A47C 3/24
USPC ..... 297/256.11, 256.12, 256.15
See application file for complete search history.

(56) References Cited

U.S. PATENT DOCUMENTS

| | | | | |
|---|---|---|---|---|
| 275,413 | A | 4/1883 | Rich | |
| D21,667 | S | 6/1892 | Marston | |
| 1,501,005 | A * | 7/1924 | Larsen | 297/250.1 |
| 2,742,953 | A * | 4/1956 | Kudrna | 248/405 |
| 2,935,122 | A * | 5/1960 | Miller | 297/256.11 |
| 3,656,805 | A * | 4/1972 | Engstrom | 297/303.5 |
| D244,107 | S | 4/1977 | Zola | |
| 4,798,412 | A * | 1/1989 | Kohus et al. | 297/256.11 |
| 4,854,638 | A * | 8/1989 | Marcus et al. | 297/256.11 |
| D314,674 | S | 2/1991 | Kohus et al. | |
| 5,297,849 | A * | 3/1994 | Chancellor | 297/344.12 |
| D357,129 | S | 4/1995 | Tiramani | |
| 5,601,338 | A | 2/1997 | Wahls | |
| 6,003,944 | A * | 12/1999 | Glockl | 297/337 |
| 6,015,190 | A * | 1/2000 | Wend | 297/378.1 |
| 6,676,213 | B1 | 1/2004 | Dlugos | |
| 7,032,970 | B1 * | 4/2006 | Kharat | 297/256.11 |
| 7,104,603 | B2 * | 9/2006 | Keegan et al. | 297/256.13 |
| 7,234,781 | B2 * | 6/2007 | Liao | 297/461 |
| 7,387,337 | B2 * | 6/2008 | Keegan et al. | 297/256.13 |
| 7,673,940 | B2 * | 3/2010 | Fritz et al. | 297/256.11 |
| 7,708,342 | B2 * | 5/2010 | Leach | 297/250.1 |
| 7,854,476 | B1 * | 12/2010 | Liu | 297/181 |
| 8,091,965 | B2 * | 1/2012 | Flannery et al. | 297/256.16 |
| 8,651,572 | B2 * | 2/2014 | Medeiros et al. | 297/256.13 |
| 2008/0054696 | A1 * | 3/2008 | McConnell et al. | 297/256.15 |
| 2010/0244518 | A1 * | 9/2010 | Fiore et al. | 297/256.11 |
| 2012/0061999 | A1 | 3/2012 | Soriano et al. | |
| 2014/0265487 | A1 * | 9/2014 | Michelson | 297/256.11 |

FOREIGN PATENT DOCUMENTS

| | | | |
|---|---|---|---|
| GB | 1514205 | * | 6/1978 |

* cited by examiner

*Primary Examiner* — Laurie K Cranmer
(74) *Attorney, Agent, or Firm* — Martin & Ferraro, LLP

(57) ABSTRACT

An adjustable height child booster seat including a seat and a base configured to be placed on an elevated surface above ground. The seat may be rotated relative to the base to move the seat and the base relative to each other in to adjust the booster seat to a desired height.

26 Claims, 7 Drawing Sheets

FIG. 1A
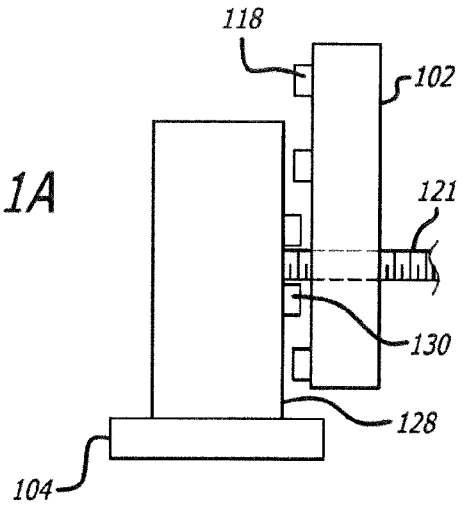
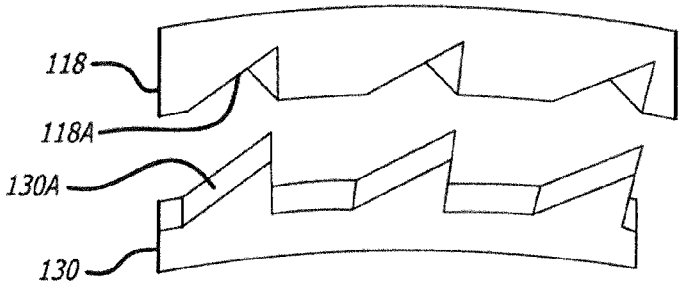
FIG. 2C
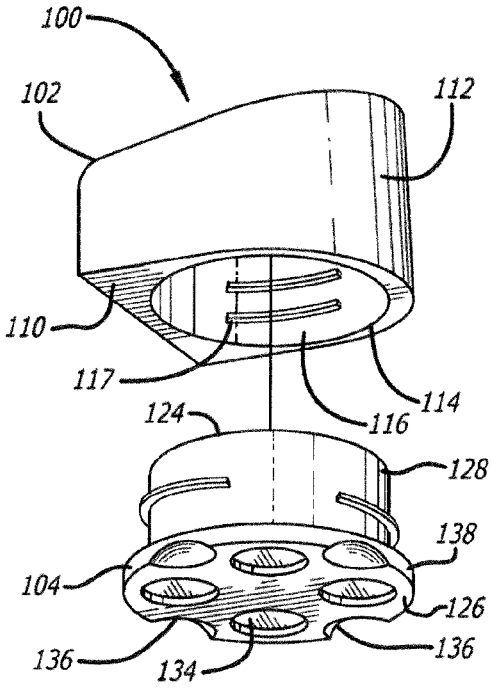
FIG. 2D

ADJUSTABLE CHILD BOOSTER SEAT

CROSS-REFERENCE TO RELATED APPLICATIONS

This application is a continuation-in-part and claims priority to U.S. patent application Ser. No. 13/839,158, entitled ADJUSTABLE CHILD BOOSTER SEAT, filed on Mar. 15, 2013; the disclosure of which is expressly incorporated by reference herein.

BACKGROUND OF THE INVENTION

It is common for young children such as toddlers to sit at a dining table. Dining surfaces such as tables and countertops are designed to have a height that is comfortable for use by older children and adults of normal stature seated on a sitting surface elevated above the ground. As the distance from an elevated sitting surface, such as a chair, a stool; or a bench, to the dining surface is usually too great to be optimal for a young child such as a toddler, a booster seat is typically used to raise the toddler over the normal height above the ground of the sitting surface of the chair, stool, or bench.

Chairs, stools, and benches have different heights as do various tables, countertops, and other dining surfaces such that the ideal amount of height to boost a child above a sitting surface varies. An additional complicating factor is that children grow quickly. Thus, a booster seat may not provide for the optimal height six months later, requiring the purchase of a taller booster seat. Therefore, a need exists for a child booster seat having an adjustable height for placement on an elevated sitting surface.

A further consideration is that toddlers are usually positioned closer to the table or counter than an adult because their arms are shorter. By being positioned closer to the table or counter, spilled food and liquids can fail in front of the toddler onto the table rather than onto them, their clothes, the chair, or floor.

Because of the total height above the ground of the child booster seat placed on an elevated sitting surface of a chair or bench, it may be necessary for an adult to lift the child into and out of the booster seat. It is desirable, therefore, for the sitting surface of the booster seat to be moved safely by the adult assisting the child in order to allow the child to be turned so that the child's knees clear the table and are properly turned to make it easier for the adult to lift the child from the booster seat.

SUMMARY OF THE INVENTION

The present invention in one preferred embodiment provides for a child booster seat having a base configured to be placed upon an elevated sitting surface above the ground, for example such as a chair, a stool, or a bench for use by an adult of normal stature, and is adjustable in its overall height as measured from the elevated sitting surface to enable a child to be appropriately further elevated to be seated at a dining surface such as a table or counter top.

In a preferred embodiment, the child booster seat is rotationally expandable in height and configured for placement on an elevated sitting surface above the ground. The booster seat comprises at least an upper seat portion including a child seating surface and a lower base portion having a bottom configured to be placed on the elevated sitting surface, at least one of the seat portion and the base portion having an engagement portion configured to be at least in part received into the other of the seat and base portions to a selectable extent. The engagement portion having a minimum width being at least twenty-five percent (25%) of the maximum overall width of the at least one of the seat portion and the base portion. The seat and base portions being configured to be in rotational engagement with each other such that when one of the seat and base portions is rotated relative to the other of the seat and base portions, the overall height of the booster seat is adjustable. The height of the booster seat as measured from the child seating surface of the upper seat portion to the bottom of the lower base portion is adjustable between a collapsed position and an expanded position. In a preferred embodiment, the height is adjustable within a range of approximately 5 inches to approximately 12 inches between the collapsed position and the expanded position.

Further, the seat portion and the base portion may be rotationally engaged to each other to allow the seat portion to be swiveled relative to the base portion.

The booster seat may be configured for placement upon at least one of a chair, a bench, a seat or a stool having a sitting surface in the range of approximately 14 inches and 22 inches above the ground. The booster seat may be configured for use with at least one of a table, a tray, and a countertop having an upper dining surface having a height of 6 inches to 20 inches above the sitting surface. The seat portion and the base portion may be rotationally engaged with each other by complimentary threads. The complimentary threads may include a male thread disposed on one of the seat and base portions and a female thread on the other of the seat and base portions, whereby the overall height of the booster seat is adjusted by the rotation of one of the seat and base portions relative to the other of the seat and base portions.

The seat portion may include an upward facing seating surface having a hollow ea defined by a supporting wall structure. The supporting structure having an inner aspect that is, at least in part cylindrical and threaded.

The base portion may have a downward facing surface for placement on the elevated sitting surface and an opposite upward facing threaded cylindrical structure forming an engagement portion of the base portion. Alternatively, the seat portion may have an upward facing sitting surface and an opposite downward facing threaded cylindrical structure forming as least part of the engagement portion of the seat portion. The base portion may have a downward facing surface for placement upon the elevated sating surface and an opposite upward facing cylindrical recess threaded to cooperatively engage the threaded cylindrical structure.

The booster seat may include a forward facing child restraint adapted to restrain a child positioned in the booster seat. The booster seat may also include a rearward facing structure adapted to secure the booster seat to a chair and/or an attachment for a downward facing strap to further secure the booster seat to the elevated sitting surface that the seat is set upon.

In another preferred embodiment, the booster seat has a base portion including a lower surface, an upper surface opposite the lower surface configured to be placed on the elevated sitting surface above the ground, and an exterior sidewall. The base portion having an insertion portion with a maximum width and a height perpendicular to the maximum width. The booster seat has a seat portion including a bottom, a top opposite the bottom, and a central longitudinal axis through the bottom and the top, the bottom including a recess with an interior sidewall. The recess having a maximum width perpendicular to the central longitudinal axis, the width of the recess being greater than the maximum width of the insertion portion of the base portion. The insertion portion of the base portion being configured to be inserted at least in part into the recess of the seat portion. The width of the insertion portion being at least twenty-five percent (25%) of the maximum width of the seat portion. The recess having a depth parallel to the central longitudinal axis of the seat portion, the depth of the recess being greater than a majority of the height of the base portion. The base portion rotatably engaging the interior sidewall of the recess to move the seat portion and the base portion relative to each other to after the height of the seat portion relative to the elevated sitting surface within a range of approximately 5 inches to approximately 12 inches above the elevated sitting surface.

In yet another preferred embodiment, the child booster seat includes an upper sitting portion and a lower base portion. The upper sitting portion and the lower base portion being rotationally coupled by complimentary male and female threads disposed one each on one of the upper sitting portion and the lower base portion. The upper sitting portion and the lower base portion being rotationally movable relative to each other to adjust the height of the booster seat between a collapsed height and an expanded height. The booster seat having a collapsed height of between approximately three to six inches and an expanded height of between approximately five to twelve inches.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE FIGURES

FIG. 1A is a cross-sectional view of a seating area and a base of the adjustable child booster seat of FIG. 1, depicting adjacent threads on the seating area and the base, and a locking mechanism in the form of a turn screw to lock the height of the seating area relative to the base.

FIG. 2C is a cross-sectional view depicting two adjacent threads on the seating area and the base of the adjustable child booster seat of FIG. 2A, wherein one thread includes a plurality of spaced apart recesses along its helical path, and the other thread includes at least one projection configured to be received in at least one of the spaced apart recesses.

FIG. 2D is a lower exploded view of an alternative embodiment of the adjustable child booster seat.

DETAILED DESCRIPTION OF THE DRAWINGS

Reference will now be made in detail to the present preferred embodiments of the invention, examples of which are illustrated in the accompanying drawings.

FIGS. 1 to 7 show a preferred embodiment of an adjustable child booster seat 100 having a seat 102 and a base 104 configured for placement on an elevated sitting surface above the ground such as for example, chair 10, bench, or seat and like type of seating appropriate for an adult of normal stature. The elevated sitting surface preferably would be elevated above the ground approximately 14-22 inches for a chair; approximately 27-35 inches above the ground for a table; and have an approximately 6-20 inch differential between the sitting surface and the dining surface of a table or countertop for example. In use, seat 102 and base 104 are rotated relative to each other to raise or lower the position of seat 102 above base 104. Preferred elements of child booster seat 100 and their interrelationship are described below.

Figure 1:
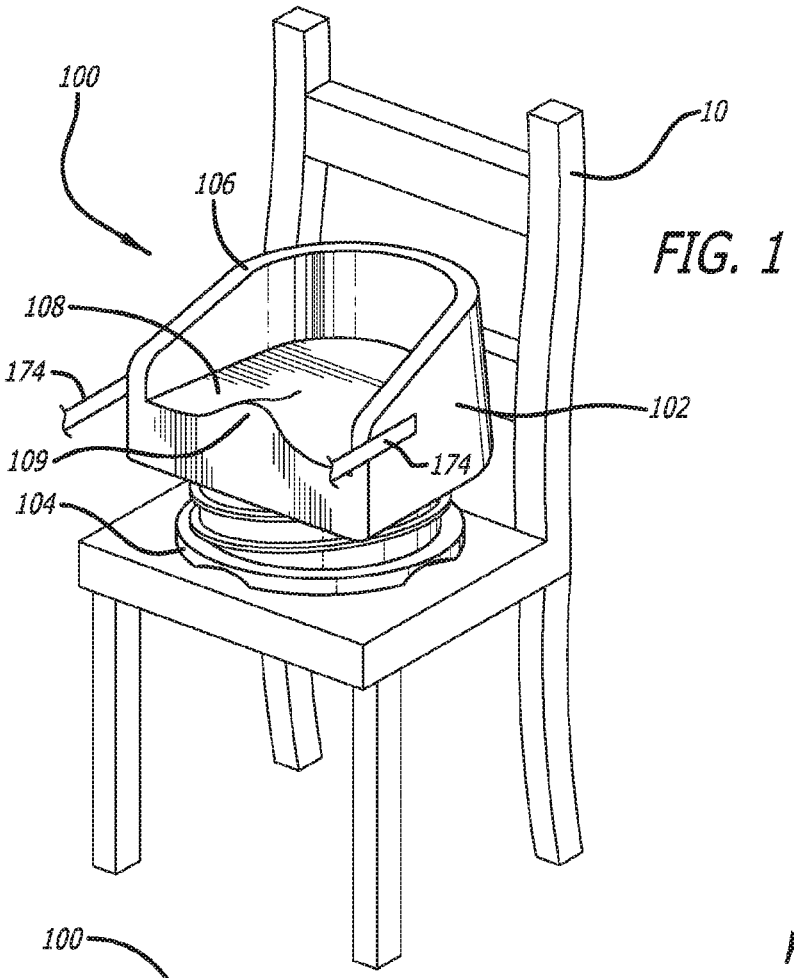
FIG. 1 is a perspective view of an adjustable child booster seat positioned on an elevated sitting surface appropriate for an adult of normal stature such as a chair in accordance with an embodiment of the present invention.
Figure 2A:
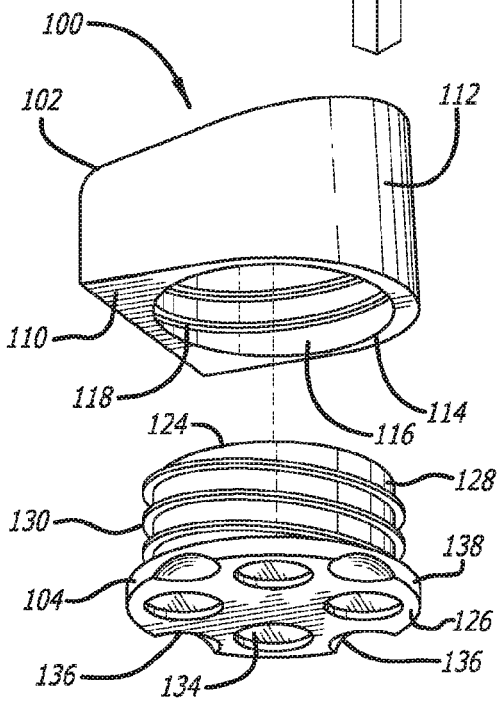
FIG. 2A is a lower exploded perspective view of the adjustable child booster seat of FIG. 1.

Referring to FIGS. 1 and 2A, seat 102 has a top 106 with a child seating area 108, a bottom 110 opposite top 106, and an exterior sidewall 112. The child seating area 108 may include a contoured recess adapted to further stabilize a child in the seat. The anterior portion of child seating area 108 may include a raised portion 109 or small knob positioned between a child's legs sitting in seat 102 to prevent the child from sliding forward and out of seat 102. Additionally, seat 102 may include a small seat back to secure the child in seat 102. Preferably, sidewall 112 extends above child seating area 108 to assist in retaining the child in the seat.

As shown in FIG. 2, bottom 110 of seat 102 preferably includes a recess 114 configured to receive at least a portion of base 104. Recess 114 includes an interior sidewall 116 preferably having a thread 118 for engaging a corresponding thread 130 on base 104, described in detail below. Thread 118 is preferably spaced apart between turns along at least a portion of the depth of recess 114. Alternatively, as shown in FIG. 2D, instead of threads 116, 118, recess 114 may include a curved inclined plane 117 without requiring a complete revolution to move seat 102 up and down as desired. The inclined plane 117 may also include a drop-off section to permit movement up and down of seat 102.

Figure 3A:
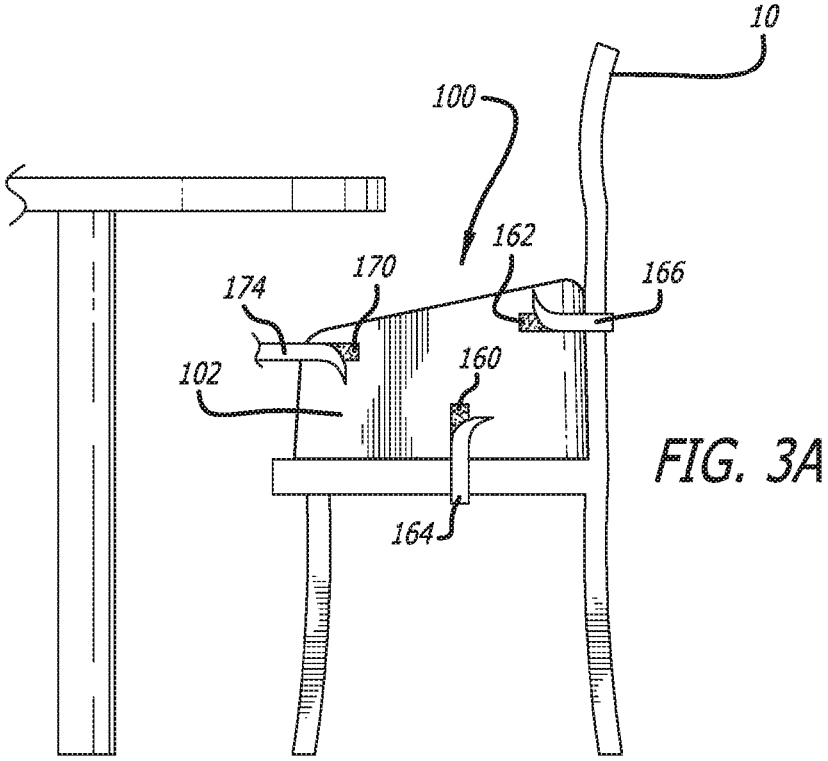
FIG. 3A is a side elevation view of the adjustable child booster seat of FIG. 1 in a collapsed position and positioned on a chair.
Figure 3B:
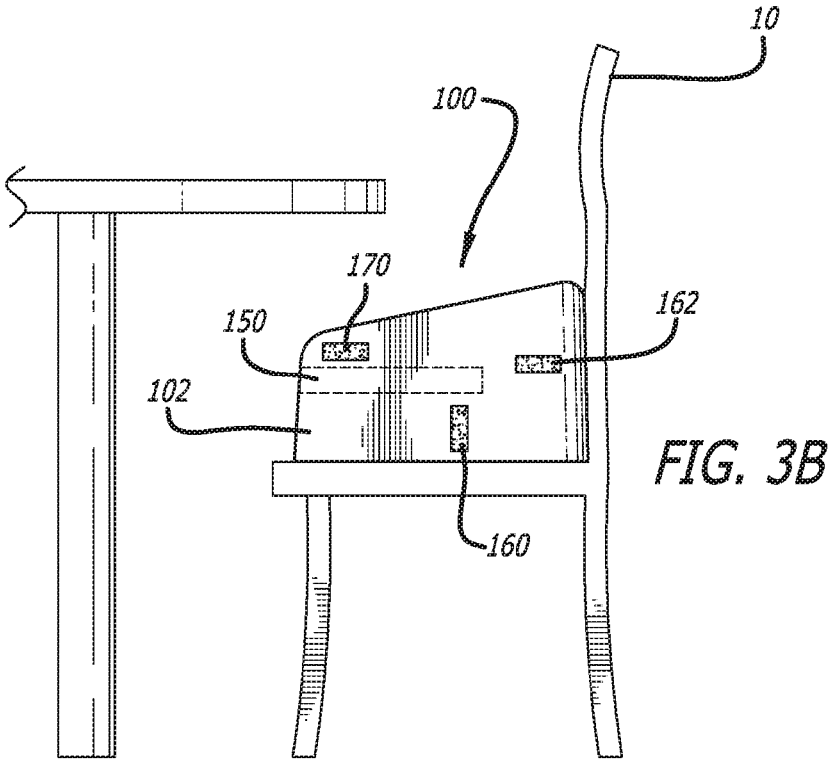
FIG. 3B is a side elevation view of another embodiment of the adjustable child booster seat of FIG. 1 in a collapsed position and positioned on an elevated sitting surface of a chair configured to engage a removable food tray and having attachment points for a safety straps used to hold the adjustable child booster seat to the chair.

As shown in FIGS. 3A and 3B, seat 102 is placed on an elevated sitting surface of chair 10. To secure seat 102 relative to chair 10, a portion of seat 102 such as exterior sidewall 112 of seat 102 may include attachment elements 160 and 162, such as at least one part of a hook and loop fastener for example, to attach restraining straps 164 and 166, respectively, to seat 102 having a corresponding part of a hook and loop fastener. Restraining straps 164, 166 can be positioned at least in part on or over at least a portion of chair 10 and prevent tipping of seat 102 relative to chair 10 or otherwise hold the position of seat 102 relative to chair 10. It is appreciated that seat 102 is preferably placed against the seatback of chair 10 such that seat 102 is supported by the seatback of chair 10 as shown in FIGS. 3A and 3B. Seat 102 also may include attachment elements 170 and 172 for attaching a safety belt 174 to secure a child seated in seat 102.

Figure 3C:
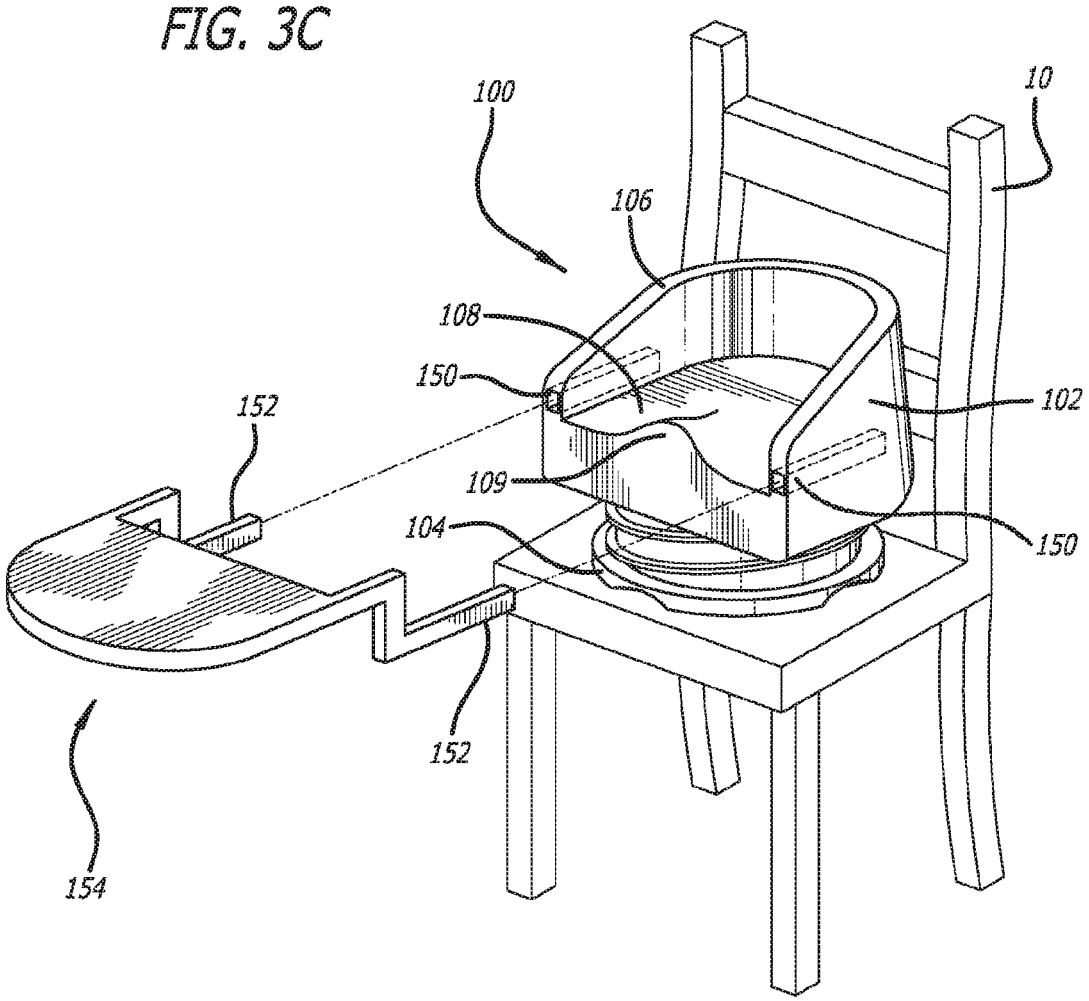
FIG. 3C is a perspective view of the adjustable child booster seat of FIG. 3B in a collapsed position and positioned on an elevated sitting surface of a chair and a removable food tray for use with the adjustable child booster seat.

Alternatively, as shown in FIGS. 3B and 3C, seat 102 may be configured to engage and hold a removable food tray 154. Tray 154 includes posts 152 extending therefrom configured to be inserted into and removed from slots 150 in seat 102 with the child sitting in seat 102. It is appreciated that the placement of tray 154 relative to the sitting area of seat 102 can be varied to accommodate the legs of a child as desired without departing from the scope of the invention.

Figure 6A:
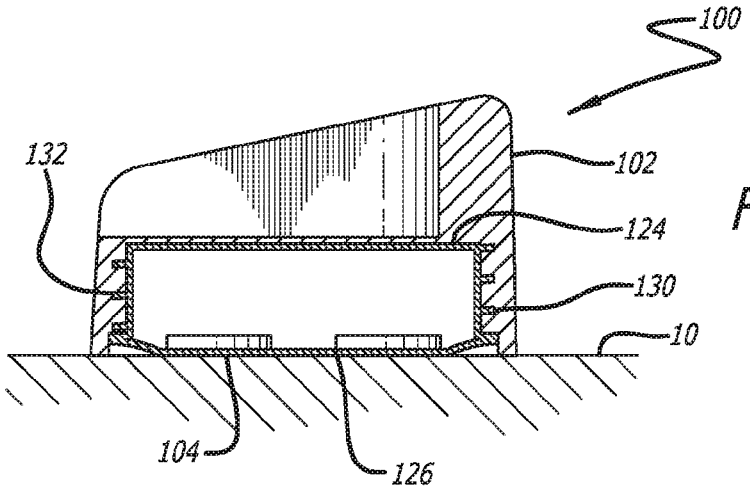
FIG. 6A is a cross sectional side view of the adjustable child booster seat of FIG. 1 in the collapsed position.

Referring to FIGS. 2A and 6A, base 104 has an upper surface 124, a lower surface 126 opposite upper surface 124, and an exterior sidewall 128. Exterior sidewall 128 preferably includes a thread 130 having multiple turns about the central longitudinal axis of base 104, and is configured to engage corresponding thread 118 of seat 102 to raise and lower seat 102 relative to base 104. It will be appreciated that any number of turns may be used as desired and appropriate for the intended purpose with less than ten turns being generally preferred. Threads 118 and 130 preferably have a blunt apex, more preferably a generally planar distal surface 132 or other thread profile to provide a safe thread suitable for use with children.

Figure 5:
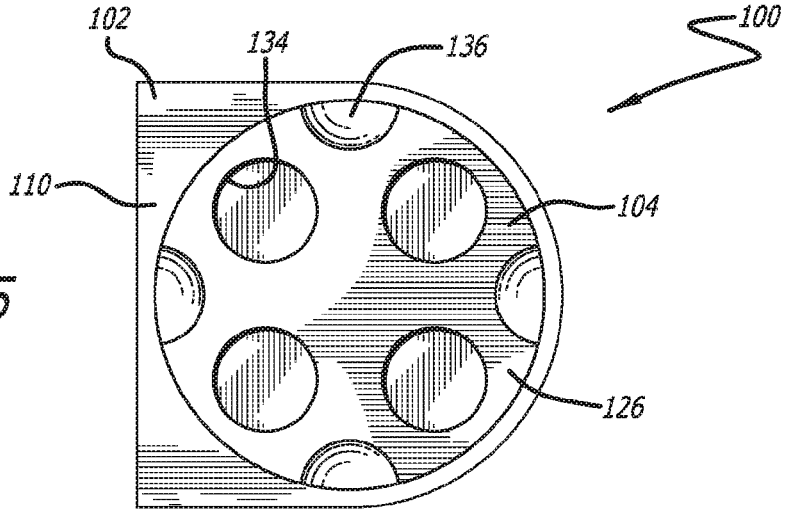
FIG. 5 is a bottom plan view of the adjustable child booster seat of FIG. 1.

Lower surface 124 of base 104 may include a plurality of engagement openings 134 and cut-outs 136 as shown in FIGS. 2A and 5 to facilitate handling of base 104 during rotation. Lower surface 124 may include suction cups or double-sided hook and loop fasteners to removably secure base 104 to the elevated sitting surface of chair 10. Openings 134 and cut-outs 136 are preferably configured to facilitate the height adjustment of booster seat 100 by permitting a user to keep base 104 steady while seat 102 is rotated to an elevated height. Cut-outs 136 are preferably arrayed along a lip 138 preferably surrounding the lower portion of base 104 so as to be accessible from both the side and the bottom of base 104.

Figure 2B:
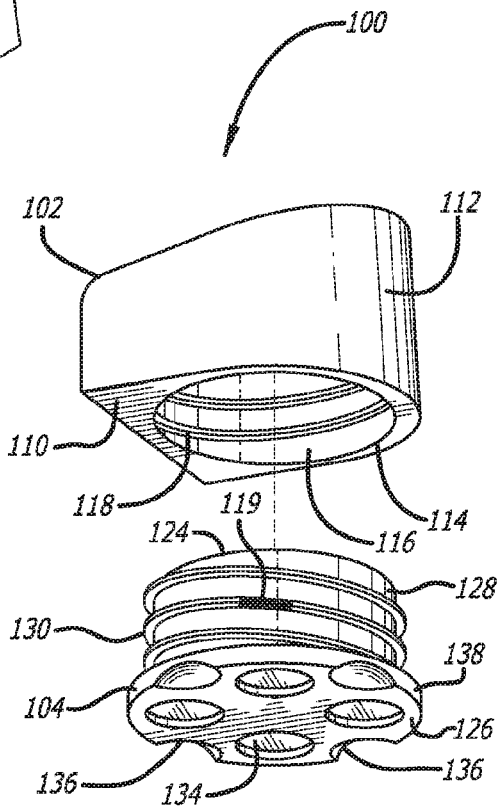
FIG. 2B is a lower exploded perspective view of an alternative embodiment of an adjustable child booster seat including a surface configured to enhance friction.

Thread 118 of seat 102 and thread 130 of base 104 are preferably configured to permit continued adjustment without preconfigured increments, though the present invention is not so limited as will be further described below. As shown in FIG. 2B, to inhibit or resist reverse rotation, one or both of thread 118 and thread 130 may include a surface 119 configured to enhance friction. The combination of a friction-enhancing surface 119 and large thread outer diameter relative to the width of the seat functions to inhibit regressive rotational motion, particularly when the child's weight is added to seat 102.

If desired, booster seat 100 may be configured with a locking mechanism to lock the height of seat 102 relative to base 104. Such a locking mechanism may be formed, for example only, as a ratcheted spring mechanism, or a turn screw 121.

Referring to FIG. 5, base 104 preferably has a relatively large and maximized footprint to provide optimal stability when placed on an elevated sitting surface. Base 104 has a maximum outer overall dimension in a generally horizontal plane perpendicular to a central longitudinal axis of base 104 passing through upper surface 124 and lower surface 126. The horizontal plane is preferably greater than a majority of a maximum outer dimension of seat 102 in a generally horizontal plane perpendicular to a central longitudinal axis of seat 102 passing through top 106 and bottom 110. More preferably, the maximum outer overall dimension of base 104 is preferably greater than twenty-five percent (25%) of the maximum outer dimension of seat 102. The portion of base 104 insertable into recess 114 of seat 102 preferably has a maximum outer dimension that is at least twenty-five percent (25%) of the maximum outer dimension of seat 102. The aforementioned reference planes may be co-planar or offset. For illustrative purposes only, the maximum outer dimensions in the aforementioned reference planes will be referred to as a "width," though the invention is not so limited. For example, the maximum dimension may also be a diameter where the outer shape of either the seat and/or base is circular. The percentage ratios set forth above may also be applicable when comparing the maximum width of base 104 relative to a maximum with of recess 114.

As shown in FIG. 6A, seat 102 preferably has a maximum overall height greater than the maximum overall height of base 104. Preferably, the maximum width of base 104 is greater than the height of base 104. Preferably the maximum outer diameter of thread 130 of base 104 is greater than twenty-five percent (25%) of the width of seat 102.

FIG. 6A also shows that recess 114 of seat 102 preferably has a depth greater than a majority of the height of base 104. More preferably, the depth of recess 114 is generally equal to the height of base 104. The depth of recess 114 may be configured in a variety of ways, and that the depth may be more or less than the height of base 104 without departing from the scope of the present invention.

Booster seat 100 may be formed from a variety of materials. For example only, booster seat 100 is preferably formed from an injection-molded, durable plastic. Booster seat 100 may be formed from a single material, or a combination of materials. Such materials may include, but are not limited to plastic, metal and/or rubber. For example only, lower surface 126 of base 104 may be formed as a rubber layer to impede the lateral movement of booster seat 100 when placed on chair 10. Either or both of seat 102 and base 104 may be made of a light-weight metal such as aluminum. Other metals may be used as desired without departing from the scope of the present invention.

Figure 4:
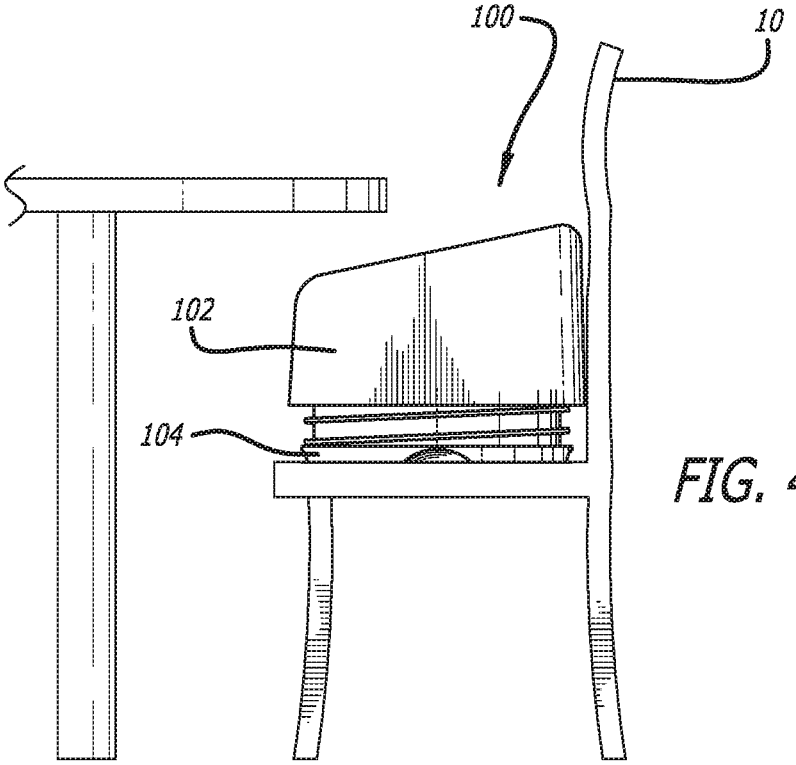
FIG. 4 is a side elevation view of the adjustable child booster seat of FIG. 1 in an expanded position and positioned on a chair.
Figure 7A:
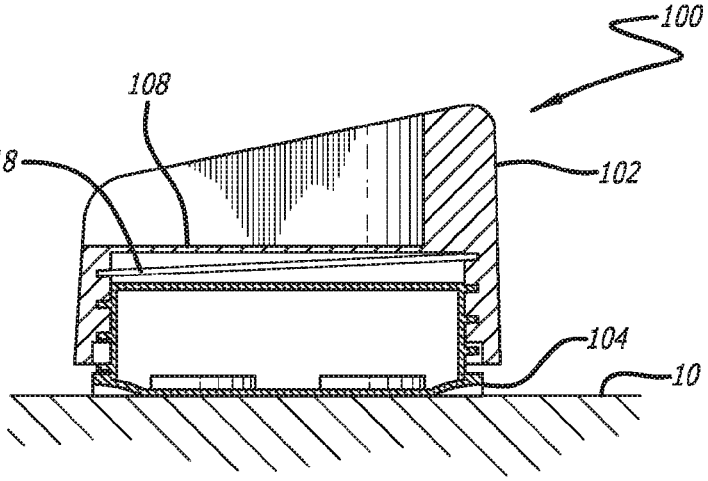
FIG. 7A is a cross sectional side view of the adjustable child booster seat of FIG. 1 in a partially expanded position.
Figure 6B:
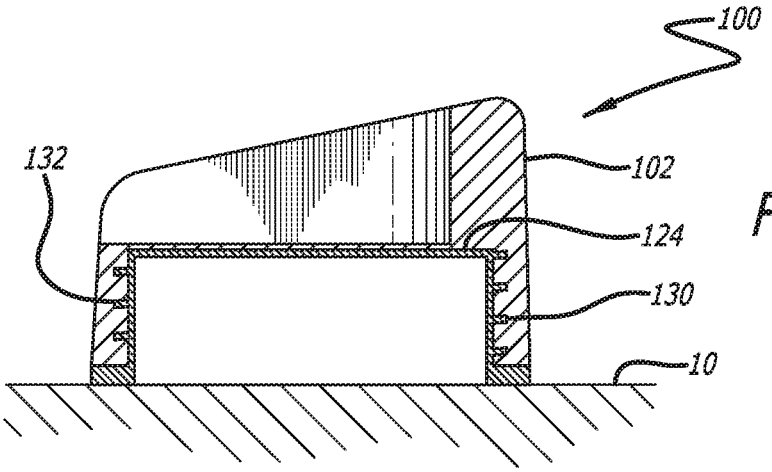
FIG. 6B is a cross sectional side view of another embodiment of the adjustable child booster seat of FIG. 1 in a collapsed position.
Figure 7B:
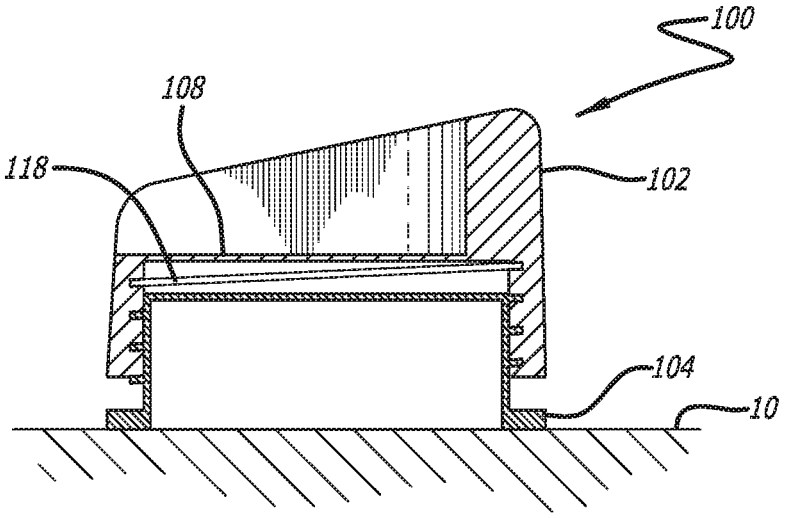
FIG. 7B is a cross sectional side view of the adjustable child booster seat of FIG. 6B in a partially expanded position.

Having described the preferred components of booster seat 100, a preferred method of use will now be described with reference to FIGS. 2A-4, 6A and 7A. Referring to FIGS. 3A and 6A, to achieve an elevated seating height of a child, booster seat 100 is placed on the seating area of an elevated sitting surface above the ground such as on chair 10. At least one of seat 102 and base 104 are rotated about their central longitudinal axes so that thread 118 of seat 102 and thread 130 of base 104 move relative to each other, axially elevating seat 102 relative to base 104 from a first, collapsed position, such as shown in FIGS. 3A and 6A, to an expanded position, such as shown in FIGS. 4 and 7A to adjust the height of booster 100 as measured from the child seating surface of seat 102 to the bottom of base 104. While it is appreciated that the range of heights to which booster seat 100 may be adjusted can vary, one preferred range of height change can be approximately 5 to approximately 12 inches as an example, between the collapsed position and the expanded position. It is appreciated that other range of height changes suitable for the intended purpose of adjusting the height of the booster seat placed on an elevated surface of conventional height (such as described herein) to permit a child to comfortably sit at an eating surface of conventional height (such as described herein) are within the intended scope of the present invention. For example, the range of height adjustment may be less than approximately 4 inches or may be greater than 12 inches without departing from the scope of the present invention. Examples of other preferred ranges of height adjustments include, but are not limited to, approximately 5 inches to approximately 9 inches and approximately 6 inches to approximately 12 inches. It is also appreciated that the height of the seating surface may be measured from the elevated sitting surface upon which the booster seat is placed such that the range of height adjustment of the seat portion relative to the elevated sitting surface would be within a range of approximately 5 inches to approximately 12 inches above the elevated sitting surface in one example of a preferred embodiment of the present invention. In another example, booster seat 100 may have a collapsed height of between approximately three to six inches and an expanded height of between 5 to 12 inches.

At least one of seat 102 and base 104 are rotated relative to each other until the desired seat height is reached. The foregoing description is by way of example only, and may be varied considerably without departing from the scope of the present invention. For example only, the seat may be formed in a variety of shapes. The child seating surface may be anatomically contoured or curved for a child.

Base 104 may be hollow, such as shown in FIG. 6A, or at least in part solid. When hollow, base 104 may have a substantially open top and/or bottom. Alternatively, base 104 may have a closed bottom and an open top to function as a storage compartment for items when travelling. When hollow, openings 134 (FIG. 5) may serve as vents to allow the easy escape of air between the top of recess 114 and base 104 as base 104 is rotated into recess 114. A substantially hollow base has many advantages. For example only, forming base 104 to be substantially hollow allows booster seat 100 to be more lightweight and less expensive to manufacture.

Base 104 and seat 102 may be configured in other ways so as to elevate seat 102 relative to base 104. In a further preferred embodiment of the present invention, the configurations of the bottom of the seat and the top of the base may be reversed. For example, instead of a recess, the seat may have a bottom portion projecting therefrom that includes a thread. The base may have a top which includes a recess into which the bottom portion of the seat threadably engages to raise or lower the seat relative to the base.

When at least one of the base 104 and seat 102 have a thread, the thread(s) may have a ratcheted surface on one or both facets of the thread. Such a configuration, as depicted in FIG. 2, would facilitate incremental elevation of the seat relative to the base. For example, thread 118 may include a plurality of spaced-apart recesses 118A along its helical path configured to receive a projection 130A on one side of thread 130. To incrementally elevate the seat relative to the base, the user may lift the seat vertically and then rotate the seat around its central longitudinal axis. Once the desired height is achieved, the user may push down on the seat and rotate the seat until the projection 130A and the recess 118A engage. As another example, the raising and lowering of seat 102 relative to base 104 may be achieved with a curved inclined plane with detents for receiving complimentary pawls on an opposite member to rotate and drop seat 102 into the next locking position. Seat 102 then remains in the locked position with weight placed on seat 102 by a child seated in seat 102. It is possible to manually distract the upper and lower portions to move them relative to each other. It will be appreciated that other ways of rotational interlocking may also be achieved by including one or more recesses on the thread configured to engage one or more corresponding projections in the groove.

The thread may include one or more indentations to interrupt an otherwise continuous outer thread diameter. The indentations may engage with a spring-loaded ratchet mechanism located along a portion of the interior sidewall of the recess of the seat.

The lower surface of the base may include one or more suction cups to enhance securing the booster seat to the chair. The booster seat may be secured to the chair in other ways without departing from the scope of the present invention. The lower surface of the base may be contoured to the shape of the intended chair. Such contouring is beneficial for maintaining the booster seat on a chair when the sitting area of the chair is non-planar. The lower surface of the booster seat may be made of a material adapted to conform to the surface against which it is placed. For example, the lower surface may be formed from a silicon or rubber material. Alternatively, the lower surface may include a recess configured to retain a weighted bag filled with granular material such as beans, pebbles or sand, which functions to conform to cushioned surfaces, such as a theater seat, and acts as a ballast to assist in maintaining the booster seat on the larger seat.

The features described with respect to one embodiment may be applied to other embodiments, or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A rotationally expandable in height child booster seat for placement on an elevated sitting surface above the ground, the booster seat comprising:

an upper seat portion including a child seating surface;

a lower base portion having a bottom configured to be placed on the elevated sitting surface, each of said seat portion and said base portion having a complementary engagement portion, each of the complementary engagement portions being configured to be at least in part received into the other of said seat and base portions to a selectable extent, said engagement portion having a minimum width being at least twenty-five percent (25%) of the maximum overall width of said at least one of said seat portion and said base portion, said seat and base portions being configured to be in rotational engagement to move said seat portion and said base portion relative to each other between a collapsed position and an expanded position to adjust the height of the booster seat, the height of the booster seat as measured from said child seating surface of said upper seat portion to said bottom of said lower base portion being adjustable within a range of 5 inches to 12 inches between the collapsed position and the expanded position; and a locking mechanism configured to lock the height of said seat portion relative to said base portion, said locking mechanism having a locked position that prevents rotation of said seat and said base portions relative to one another and an unlocked position that permits rotation of said seat and said base portions relative to one another;

wherein said complementary engagement portions of said seat portion and said base portion comprise complementary inclined planes, at least one of said complementary inclined planes having at least one complementary projection on a surface thereof, and another of the at least one of said complementary inclined planes having at least one complementary recess on a surface thereof, said at least one complementary recess being configured to receive said at least one complementary projection.

2. The booster seat of claim 1, wherein said lower base portion is configured for placement upon at least one of a chair, a bench, a seat and a stool having the elevated sitting surface within a range of 14 inches to 22 inches above the ground.

3. The booster seat of claim 1, wherein at least one of said upper seat portion and said lower base portion is configured for use with at least one of a table, a tray, and a countertop having an upper dining surface having a height within a range of 6 inches to 20 inches above the elevated sitting surface.

4. The booster seat of claim 1, wherein said child seating surface of said upper seat portion comprises an upward facing seating surface, said upward facing seating surface having a hollow area defined by a supporting wall structure, said supporting wall structure having an inner aspect that is at least in part cylindrical.

5. The booster seat of claim 1, wherein said lower base portion has a downward facing surface for placement on the elevated sitting surface and an opposite upward facing cylindrical structure, said upward facing structure comprising at least part of said engagement portion of said base portion.

6. The booster seat of claim 1, wherein said child seating surface of said upper seat portion comprises an upward facing sitting surface and an opposite downward facing cylindrical structure, said downward facing cylindrical structure comprising at least part of said engagement portion of said seat portion.

7. The booster seat of claim 6, wherein said lower base portion comprises a downward facing surface for placement upon the elevated sitting surface and an opposite upward facing cylindrical recess configured with one of said complementary engagement portions to cooperatively engage the other of said complementary engagement portions on said cylindrical structure.

8. The booster seat of claim 1, further comprising a forward facing child restraint adapted to restrain a child positioned in said booster seat.

9. The booster seat of claim 1, further comprising a rearward facing structure adapted to secure said booster seat to a chair.

10. The booster seat of claim 1, further comprising a removable tray.

11. The booster seat of claim 1, wherein said seat portion and said base portion are rotationally engaged to each other to allow said seat portion to be swiveled relative to said base portion.

12. The booster seat of claim 1, wherein said locking mechanism includes a turn screw.

13. An adjustable height child booster seat for placement on an elevated sitting surface above the ground, said booster seat comprising:

a base portion including a lower surface, said lower surface being configured to be placed on the elevated sitting surface above the ground, an upper surface opposite said lower surface, an exterior sidewall, and an insertion portion, the insertion portion including a maximum width, a height perpendicular to the maximum width, an exterior surface, and a first set of threads defined on the exterior surface;

a seat portion including a bottom, a top opposite said bottom, and a central longitudinal axis through said bottom and said top, said bottom including a recess with an interior sidewall, said recess having a maximum width perpendicular to the central longitudinal axis, the maximum width of said recess being greater than the maximum width of said insertion portion of said base portion, said insertion portion of said base portion being configured to be inserted at least in part into said recess of said seat portion, said maximum width of said insertion portion being at least twenty-five percent (25%) of the maximum width of said seat portion, said recess having a depth parallel to the central longitudinal axis of said seat portion, the depth of said recess being greater than a majority of the height of said base portion, said base portion rotatably engaging said interior sidewall of said recess, the interior sidewall including a second set of threads defined thereon, the second set of threads being engageable with the first set of threads, to move said seat portion and said base portion relative to each other to alter a height of said seat portion relative to the elevated sitting surface within a range of 5 inches above the elevated sitting surface to 12 inches above the elevated sitting surface; and a locking mechanism configured to lock the height of said seat portion relative to said base portion, said locking mechanism having a locked position that prevents rotation of said seat and said base portions relative to one another and an unlocked position that permits rotation of said seat and said base portions relative to one another;

wherein one of at least one of said first set of threads and at least one of said second set of threads has at least one recess defined therein, and another of said at least one of said first set of threads and at least one of said second set of threads has at least one projection defined thereon, said at least one recess being configured to receive therethrough said at least one projection.

14. The booster seat of claim 13, wherein the maximum width of said insertion portion of said base portion is greater than the height of said base portion.

15. The booster seat of claim 13, wherein said recess has a generally circular cross section perpendicular to the depth of said recess.

16. The booster seat of claim 13, wherein said lower surface of said base portion includes a non-slip material configured to increase friction between said base portion and the elevated sitting surface.

17. The booster seat of claim 13, wherein said lower surface of said base portion includes at least one engagement recess configured to permit a user to facilitate rotation of said base portion relative to said seat portion.

18. The booster seat of claim 13, wherein at least one of said base portion and said seat portion is formed at least in part of a plastic material.

19. The booster seat of claim 13, wherein said second set of threads has a maximum outer diameter greater than a majority of the maximum width of said seat portion.

20. The booster seat of claim 19, wherein the maximum outer diameter of said thread falls within a range of 70% of the maximum width of said seat portion to 90% of the maximum width of said seat portion.

21. The booster seat of claim 13, wherein said seat portion includes a contoured recess adapted to stabilize a child seated in said booster seat.

22. The booster seat of claim 13, wherein an interior portion of said seat portion includes a raised portion adapted to be positioned between a child's legs to prevent the child seated in said seat portion from sliding out of said booster seat.

23. The booster seat of claim 13, wherein at least one thread of said first set of threads, and at least one thread of said second set of threads includes a surface configured to enhance friction between said exterior sidewall of said base portion and said interior sidewall of said recess, to inhibit regressive rotational motion of said seat portion relative to said base portion.

24. The booster seat of claim 13, further comprising a seatbelt to secure a child seated in said booster seat.

25. The booster seat of claim 13, wherein at least one thread of said first set of threads and at least one thread of said second set of threads has at least one ratcheted surface on at least one facet thereof.

26. A child booster seat comprising:

an upper sitting portion, said upper sitting portion including a first thread, said first thread having upper and lower facets;

a lower base portion, said lower base portion including a second thread, said second thread having upper and lower facets, said upper sitting portion and said lower base portion being rotationally movable relative to each other to adjust the height of said booster seat between a collapsed height and an expanded height, said booster seat having a collapsed height falling within a range of three inches to six inches and an expanded height falling within a range of five inches to twelve inches, at least one of said first thread of said upper sitting portion and said second thread of said lower base portion including at least one ratcheted surface on at least one of said upper and lower facets thereof, said ratcheted surfaces being configured to facilitate incremental elevation of the upper sitting portion relative to the lower base portion; and a locking mechanism configured to lock the height of said seat portion relative to said base portion, said locking mechanism having a locked position that prevents rotation of said seat and said base portions relative to one another and an unlocked position that permits rotation of said seat and said base portions relative to one another.

* * * * *